United States Patent [19]

Norwood

[11] Patent Number: 4,892,601

[45] Date of Patent: Jan. 9, 1990

[54] POLE REPAIR SYSTEM

[75] Inventor: Leslie S. Norwood, Northants, England

[73] Assignee: Scott Bader Company Limited, Northamptonshire, United Kingdom

[21] Appl. No.: 229,505

[22] Filed: Aug. 8, 1988

[30] Foreign Application Priority Data

Aug. 13, 1987 [GB] United Kingdom ..... 8719143

[51] Int. Cl.[4] ..... B32B 35/00

[52] U.S. Cl. ..... 156/94; 52/514; 156/185; 264/36; 405/216; 427/140; 428/63

[58] Field of Search ..... 156/94, 185; 52/514; 264/36; 405/216; 427/140; 428/63

[56] References Cited

U.S. PATENT DOCUMENTS

| | | | |
|---|---|---|---|
| 195,990 | 10/1877 | Culver | 156/185 |
| 2,875,020 | 2/1959 | Ring | 427/440 X |
| 2,897,553 | 8/1959 | Gorrow | 405/216 X |
| 2,955,331 | 10/1960 | Nelson | 118/268 |
| 3,390,951 | 7/1968 | Finger et al. | 405/216 X |
| 3,409,388 | 11/1968 | Nelson | 427/441 |
| 4,543,764 | 10/1985 | Kozikowski | 405/216 X |

FOREIGN PATENT DOCUMENTS 0178842 4/1986 European Pat. Off. .

*Primary Examiner*—Robert A. Dawson

*Attorney, Agent, or Firm*—Cushman, Darby & Cushman

[57] ABSTRACT

A method of repairing, protecting or strengthening a utility pole projecting from the ground comprises fitting a compressible elastomeric interlayer around the pole so as to mechanically bind the interlayer to the pole, fitting a sleeve around the pole clad with the elastomeric interlayer, filling the clearance between the interlayer and the sleeve with a flowable hardenable composition essentially free from shrink on hardening, and allowing the composition to harden so as to form a solid core mechanically bonded to each of the interlayer and the sleeve. This method therefore provides an assembly of structural components each mechanically bonded one to the next.

16 Claims, 2 Drawing Sheets

POLE REPAIR SYSTEM

FIELD OF THE INVENTION

This invention relates to an improved system for repairing and/or protecting and/or strengthening utility poles.

BACKGROUND OF THE INVENTION

Utility poles are widely used to support overhead power and telecommunication lines. Wooden utility poles are pressure impregnated before installation with materials such as creosote to minimise rotting but this still occurs, usually from the centre outwards.

The reasons for rotting usually are that (a) the preservation does not penetrate to the centre of the poles; and (b) some soils contain chemical compounds that are particularly aggressive even towards treated timbers.

Conventionally a utility pole is sunk to a depth of around 1–1.5 meters so that the lowermost region often lies below the natural water table. Water tends to wick upwardly towards ground level, above which it is free to evaporate. Thus, some time after installation, the pole tends to become permanently saturated below ground level.

Rotting of the pole at least to some extent, is caused by spores of fungi in the atmosphere, which spores are particularly active at the higher temperatures above ground level but also in the moist environment below ground level.

According, rotting is most likely to occur at or just above ground level, the very region where the maximum bending moment is applied and therefore where the pole needs to be strongest.

Indeed, high bending stresses occur during extreme weather conditions and even new poles can be broken. For this reason poles which have lost more than 40% of their integrity (i.e. have a strength less than 60% of their original nominal strength) are replaced. This is not always easily accomplished as poles are often located in sites inaccessible to transport so that lengthy disruption of services can occur. Even though they may rot, wooden poles are still preferred in many parts of the world because of the availability of wood (and they are comparatively easily cleaned by a properly equipped workman). Alternatives to wooden poles, such as reinforced concrete and glass reinforced plastics, can also suffer damage at or about ground level.

The present invention is designed to provide a means and method for improving the in situ repair of utility poles.

For such a repair system to be viable it should be capable of reinforcing poles to a strength equivalent to that of new ones, should be easy to accomplish on site, should need access only to the base of the pole so that there is no disruption of services and should be resistant to corrosive and other attack so as to give the pole a long life without further maintenance.

A number of methods of pole repair have been the subject of patents including our own EP-A-No. 0178842. This describes a method of in-situ repairing a utility pole by providing a sleeve surrounding a substantial length of pole (below and above ground) and pouring a non-shrink hardenable pourable composition into the annulus between the pole and the sleeve so as to form a solid core bonded to both sleeve and pole.

Whilst this system works well for a time, expansion forces generated within the pole, e.g. by high moisture content, can cause the pole to swell and then the cast annular material to split and finally the sleeve material to break, especially at the joint.

SUMMARY OF THE INVENTION

We have found that these problems can be overcome by the use of a compressible interlayer between the pole and the core material.

According to the invention means for repairing in situ and/or strengthening and/or protecting a utility pole projecting out of the ground comprise a rigid sleeve for positioning around the pole over a substantial length thereof in the region of the pole which is damaged, or is susceptile to damage, usually at the transition from below-ground to above-ground, the inner periphery of the sleeve being spaced from the pole, a compressible elastomeric material for providing an interlayer bonded to the pole and a hardenable core material for placing in the space between the interlayer and the sleeve. The means may further include a stop for the bottom of the sleeve to prevent egress of the core material from that bottom.

The invention further provides a utility pole surrounded for a substantial length in its damaged region and/or the region to be strengthened and/or protected by a compressible elastomeric interlayer bonded to the pole and to a composite comprising a hardened core surrounding and bonded at least mechanically to the compressible elastomeric interlayer and hardened in situ between the interlayer and a sleeve surrounding, and bonded at least mechanically to the core.

Furthermore the invention provides a method of repairing in situ and/or strengthening, and/or protecting a utility pole comprising providing a compressible elastomeric interlayer around the pole so that the interlayer is at least mechanically bonded to the pole, placing a sleeve around the pole surrounded by the interlayer and spaced from the interlayer over a substantial length of the pole at a region thereof to be repaired and/or strengthened and/or protected, filling between the sleeve and the interlayer with a hardenable core material and allowing the hardenable core material to harden. The hardenable material should be selected to bond both to the sleeve and the interlayer. There must be at least a mechanical bond between all four elements (pole, interlayer, core and sleeve) to achieve the desirable results of the invention.

It can be seen that these expedients allow the pole at least to be efficiently protected and strengthened, and in particular, they provide a readily-usable in-situ repair capacity. The repaired pole has four structural components in the repaired region; itself, the interlayer, the hardened core and the sleeve: the latter remaining as part of the finished assembly.

In all these aspects the sleeve may be a split sleeve, being split lengthwise into two or more portions and being joinable together mechanically, adhesively or by both methods. Preferably it will be positioned so that it is approximately equally below and above ground (which will normally require excavation of the ground immediately around the pole).

Thus, as mentioned above, rotting of an unprotected pole tends to occur at or just above ground level where the pole is permanently saturated with water. By surrounding the pole with a protective sleeve at this region, the water is encouraged to wick further up the pole towards the top of the sleeve, where it can evaporate.

Accordingly, the sleeve lengthens the life of the pole since any renewed rotting will tend to occur higher up the pole, so it can last for a further 20–30 years and furthermore protects and strengthens the pole at its fulcrum at ground level where maximum bending moments are applied.

Moreover, the interlayer surrounding the pole allows compensation for any expansion or contraction of the pole due to changes in temperature and/or moisture conditions, and/or certain movement due to applied stresses.

In particular, the interlayer can compress on expansion of the pole due to the increased moisture content caused by the water rising from the ground up to the upper level of the sleeve.

By accommodating such expansion of the pole, the interlayer protects the surrounding core against such radial forces and thereby prevents it from splitting or cracking.

A preferred length for the sleeve is usually between 0.5 m and 3 m, which will usually be evenly shared between above and below ground portions of the pole. The sleeve may extend to the bottom of the pole, say, 1–1.5 meters below the ground or may terminate short of the bottom of the pole. As a rule of thumb, the length of the sleeve should be the length of the region which is damaged or rotted, or is susceptible to such damage or rotting, plus 0.5 m.

During bending the principal stress is in the tensile plane, so it is preferable that sleeve or its material has highly directional (anisotropic) properties, i.e. high strength in the direction of the sleeve length. Such sleeves can be made from unsaturated polyester, vinyl ester or epoxide resins reinforced with glass, polyaramide, carbon or metallic fibres preferably running at least primarily in the direction of length of the sleeve. Pultrusion is one method of manufacture but other moulding processes can be used. Glass reinforced cement (GRC) and fibre (especially glass) reinforced thermoplastics (FRP) can also be used as the sleeve.

Isotropic materials which have equivalent strengths in the principal direction to the above anisotropic materials such as stainless steel and alloys, other corrosion resistant metals and coated metals can also be employed to make the sleeve.

To ensure good adhesion between core material and the sleeve the inner surface of the sleeve may be roughened and/or treated with a primer.

Likewise the surface of the pole should be treated before putting the sleeve and interlayer in place to remove any loose material, dirt etc and primed if necessary, so as to improved the mechanical key between the interlayer and the pole.

At the bottom of the sleeve there should be a unit which seals the orifice between the sleeve and the pole and this may at the same time locate the pole centrally to the sleeve. Alternatively with some core materials the seal may be made with earth.

The core material can be a wide range of substances both inorganic and organic which fulfill two functions:

(a) bonding to both sleeve and interlayer, at least in the mechanical sense of cohering or adhering with them, and preferably forming a full physico-chemical bond, and (b) allowing the load transfer from pole to sleeve via the interlayer and the core material when bending stresses are applied.

These core materials should be readily handleable on site, be usable under varying weather conditions, have minimum, preferably zero, volume shrinkage, be of sufficiently low viscosity to fill cracks and fissures in the wooden pole, be pourable in stages without problems and be stable and weather resistant. Cure of the core to a crosslinked state should be rapid.

It is particularly preferred that the core materials be capable of expansion on curing.

Among the suitable core materials are:

Grouting cement formulated to give zero volume shrinkage.

Fast setting magnesium phosphate cements e.g. as described by Abdelrazig et al, British Ceramic Proceedings No. 35 September 84 pages 141–154.

High density urethane foam systems.

Cast thermoset resins with antishrink additives.

Particularly preferred materials are magnesium phosphate cements, such as a magnesium ammonium phosphate cement, because they expand on setting.

The compressible interlayer is of an elastomeric material, preferably inert, which is capable of being compressed, preferably up to, say, 50% more preferably 20% or even less, of its original thickness, but which is still able to transmit the principal bending stresses that the pole repair will be subjected to in use.

The elastomeric material is capable of bonding, at least mechanically, to both the pole and to the core material on setting of the hardenable material.

The bond between the pole and the elastomeric material may be formed by winding the interlayer around the pole under tension, while the bond between the elastomeric material takes place on setting of the hardenable core, the core forming a mechanical key with the elastomeric layer.

This bond between the core and the elastomeric layer is particularly strengthened if the hardenable material forming the core expands on hardening, thereby compressing the elastomeric interlayer.

Such expansion of the hardenable material may also reinforce the mechanical key between the interlayer and the pole by virtue of the compression of the interlayer against the pole.

In any event, the bonding between the pole and the interlayer and between the interlayer and the core should be such as to allow transmission of stresses in the pole through the interlayer to the core and hence to the sleeve, so that the sleeve becomes a structural component.

Such an interlayer may be a closed cell foam, preferably having a density, before application to the pole, of 0.1–0.8 g/cc, and preferably of a rubber material, for example, polychloroprene, chlorosulphonated polyethylene or acrylonitrile/butadiene suitably formulated to be inert to the repair environment.

The thickness of the layer is dependent on the size of the pole but must be capable of being compressed sufficiently to absorb a maximum wood expansion in the range of 2–4% of the diameter of the pole.

Typically, the thickness of the material for providing the interlayer, before application to the pole is 2–8 mm.

Usually, it is preferable to use only a single interlayer around the pole.

However, it is possible to provide two or more interlayers, each of which may be of the same or a different material.

For example, it is possible to provide two layers each of different respective materials, the inner layer adjacent to pole being of a material of relatively low density and capable of substantial compression in response to expansion of the pole and the outer layer adjacent to the core being of a material of a relatively higher density and capable of resisting such expansive forces.

On assembly of the pole repair system, the gap between the pole and the surrounding sleeve may be between 5 and 75 mm typically 10–25 mm, especially 15–25 mm all round.

The gap between the interlayer and the sleeve may be 10–65 mm, typically 10–20 mm.

The compressible material of the interlayer can be in the form of a tape or sheet which may be wound under tension around the pole or a sleeve whose internal diameter is not greater than the minimum diameter of the pole, which sleeve is expanded so as to enable it to slide over the pole.

The tension applied to the material of the interlayer on application thereof to the pole should be only a light tension and in any event should not be so high as to significantly affect adversely the ability of the interlayer to expand and contract in response to movement of the pole.

When, as is preferred, the interlayer is provided by a tape wound around the pole, a slight air gap may be provided between adjacent turns around the pole. This allows for lateral expansion of the tape, which provides expansion of the tape in an essentially longitudinal direction with respect to the pole.

Preferably, the interlayer extends along the pole from a region at or near the upper axial end of the sleeve to a region below the surface of the ground, though it usually terminates short of the lower axial end of the sleeve, in which case, at a lower region of the pole the hardenable core material will be bonded directly to the pole.

Thus, as mentioned above, at lower regions of the pole, it soon tends to become permanently saturated with water, after which time there is very little risk of significant further expansion or contraction of the pole. Accordingly, in such lower regions the hardenable material forming the core may be allowed to bond directly to the pole without any significant risk that subsequent expansion or contraction of the pole will cause splitting or breakage of the core.

DESCRIPTION OF PREFERRED EMBODIMENT

Figure 1:
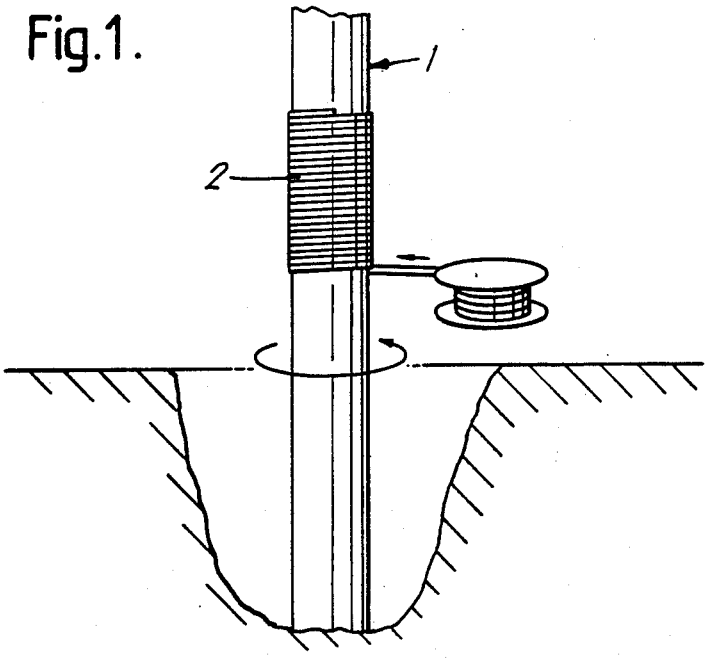
FIG. 1 is a plan view of a pole to be repaired being wrapped with a compressible elastomeric material.

The following example describes the invention with reference to FIGS. 1–4.

Example (Best Method)

A 250 mm diameter standing pole (1) with the ground level excavated to a depth of 1 meter around the base is prepared for repair by removing any loose material, dirt etc. by scraping clean. A 20 mm wide, 5 mm thick closed cell foamed polychloroprene rubber strip (2) of density 0.25 gms/cc is attached to the pole approximately 1 metre above normal ground level and helically wound around the pole under slight tension carefully butting the strips until coverage is completed to a depth equivalent to 300 mm below normal ground level (see FIG. 1).

A 2 meter long, 300 mm internal diameter glass reinforced polyester two-piece sleeving system (3) is clipped together, symmetrically placed around the pole and the bottom sealed by earth.

Figure 2:
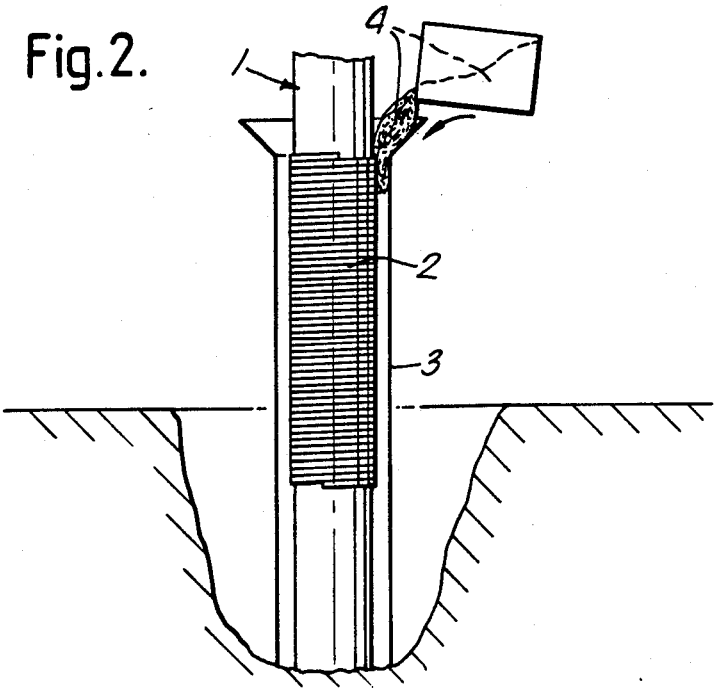
FIG. 2 is a plan view of the wrapped pole of FIG. 1 being covered with a hardenable material and a sleeve.

An inert hardenable core material (4), such as a magnesium phosphate cement, for example, a magnesium ammonium phosphate cement, is then poured between the sleeve and the rubber encased pole, totally filling the annular space (see FIG. 2). Finally the earth is made good back to normal ground level around the sleeve to complete the repair.

Figure 3:
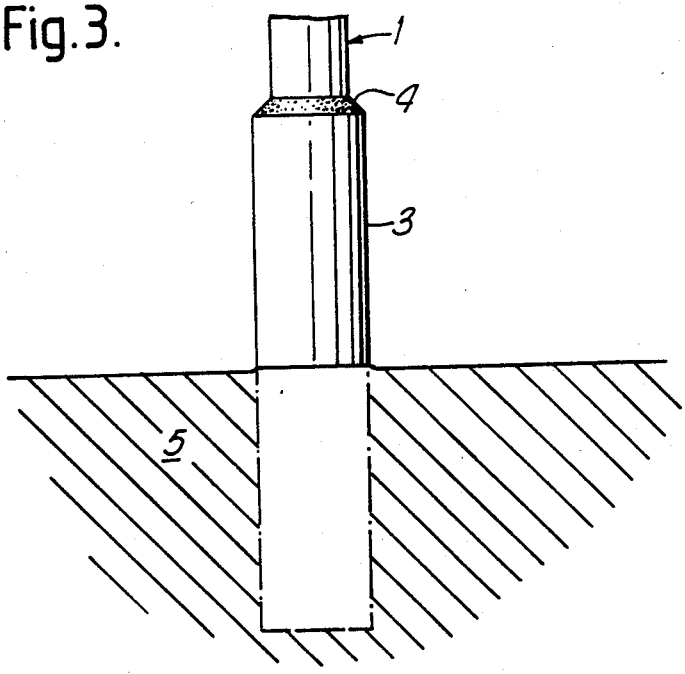
FIG. 3 is a plan view of the completely repaired pole in the ground.
Figure 4:
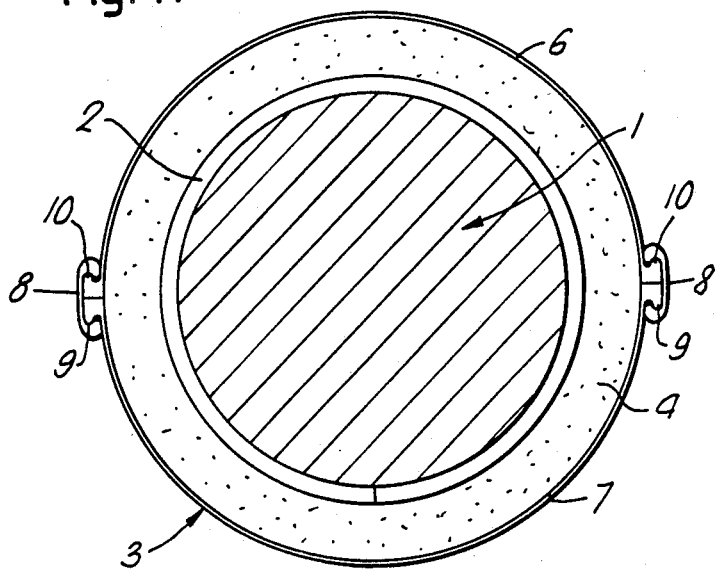
FIG. 4 is a transverse sectional view of the repaired pole.

FIG. 3 shows a plan view of a completely repaired pole 1 in the ground 5, though the interlayer (2) is not visible, while FIG. 4 shows a transverse sectional view of the repaired pole, in which view the interlayer (2) is clearly visible.

The construction of a particularly preferred system for clipping the two-piece sleeving system (3) together can be seen in FIG. 4, in which two sleeve parts 6,7 are held firmly together by two elongate profiled clips 8 each slidable over a respective pair of abutting profiled flanges 9,10 at respective opposite longitudinal edges of the sleeve parts 6,7 so as to hold the sleeve parts 6,7 together.

By using a method in accordance with the invention it is possible to repair and/or protect and/or strengthen a utility pole.

Using the repair system in accordance with the invention, it is possible to reinforce poles to a strength equivalent to that of new ones. Such repair is easy to accomplish on site and requires access only to the base of the pole so that there is no disruption of services.

The repair system is resistant to corrosive and other attack so as to give the pole a long life without further maintenance.

I claim:

1. A method selected from repairing, protecting and strengthening a utility pole (1) projecting from the ground, which method comprises fitting a compressible elastomeric interlayer around the pole so that the interlayer is at least mechanically bonded to the pole, fitting a sleeve around the pole so as to provide a clearance between the sleeve and the interlayer surrounding the pole, introducing into the clearance between the sleeve and the interlayer a flowable hardenable composition, which said composition is essentially free from shrink on said hardening, and allowing the composition to harden so as to form a core, which core is at least mechanically bonded both to the interlayer and to the sleeve, and thereby forming an assembly in which each of the pole, the interlayer, the core and the sleeve provides a respective structural component of the assembly.

2. A method according to claim 1, wherein the flowable hardenable composition is capable of expansion on said hardening, whereby expansion of said composition on said hardening causes compression of the said compressible elastomeric interlayer, the said expansion thereby strengthening the mechanical bond at least between the interlayer and the core and the said expansion strengthening the mechanical bond between the core and the sleeve.

3. A method according to claim 2, wherein the flowable hardenable composition is a magnesium phosphate cement.

4. A method according to claim 3, wherein the flowable hardenable composition is a magnesium ammonium phosphate cement.

5. A method according to claim 1, wherein, on fitting the compressible elastomeric interlayer around the pole, tension is applied to the said interlayer to cause the said mechanical bonding thereof to the pole.

6. A method according to claim 5, wherein the compressible elastomeric interlayer is wound around the pole under the said tension and is selected from a tape and a sheet.

7. A method according to claim 5, wherein the compressible elastomeric interlayer is an elastomeric sleeve expanded radially to allow passage thereof over the pole.

8. A method according to claim 1, wherein the compressible elastomeric layer is capable of being compressed at least by an amount such that the interlayer is compressed by up to at least 50% of the original thickness thereof prior to fitting thereof around the pole.

9. A method according to claim 1, wherein the compressible elastomeric interlayer is a closed cell foam.

10. A method according to claim 9, wherein the density of the foam is from 0.1 to 0.8 g/cc inclusive.

11. A method according to claim 1, wherein the compressible elastomeric interlayer is selected from the group consisting of polychloroprene, chlorosulphonated polyethlene and a copolymer of acrylonitrile and butadiene.

12. A method according to claim 1, wherein the sleeve is anistropic, with high tensile resistance in the direction of its length.

13. A method according to claim 1, wherein the sleeve comprises a plurality of identical parts fitted together around the pole.

14. A method according to claim 13, wherein each part has an arcuate transverse cross-section and profiled longitudinal flanges at each of opposed longitudinal edges, which flanges, on assembly of the sleeve, are each in abutting relationship with a flange of an adjacent said part so as to provide respective mutually facing said profiled flanges, the said arcuate-section parts thereby together defining the sleeve and the said parts being fitted together by slidably engaging, over each said pair of mutually facing profiled flanges, a respective elongate clip correspondingly profiled so as to be capable of receiving the said pair of profiled flanges.

15. In a method selected from repairing, protecting and strengthening a utility pole projecting from the ground by forming an assembly including the said pole, in which method a flowable hardenable composition is introduced into a clearance between the pole and a sleeve surrounding the pole and allowed to harden to form a core, whereby the sleeve is mechanically bonded to the pole on hardening of the composition, the improvement comprising fitting a compressible elastomeric interlayer around the pole so that the interlayer is at least mechanically bonded to the pole and selecting as the said flowable hardenable composition, a composition which, on hardening, is essentially free from shrink and is capable of forming at least a mechanical bond both with the interlayer and with the sleeve, whereby each of the pole, the interlayer, the core and the sleeve are at least mechanically bonded one to the next and each thereby provides a respective structural component of the assembly.

16. In an assembly comprising (a) a utility pole projecting upwardly from ground level and having a region selected from a repaired, protected and strengthened said region, (b) a sleeve and (c) a solid core disposed between the pole and the sleeve and having a contact surface contacting the sleeve, which solid core is at least mechanically bonded to the sleeve over the said contact surface therewith, the improvement comprising (d) an interlayer of compressible elastomeric material surrounding the pole so as to lie between the solid core and the pole, the said interlayer being at least mechanically bonded to each of the pole and the solid core whereby, in the said assembly, each of the pole, the interlayer, the solid core and the sleeve provides a respective structural component of the assembly.

* * * * *